US006304719B1

(12) United States Patent
Mo

(10) Patent No.: US 6,304,719 B1
(45) Date of Patent: Oct. 16, 2001

(54) RADIANT HEATER WITH HALOGEN LAMP

(75) Inventor: Lee Keun Mo, Songnam (KR)

(73) Assignee: Sella Tech Co., Ltd. (KR)

( * ) Notice: Subject to any disclaimer, the term of this patent is extended or adjusted under 35 U.S.C. 154(b) by 0 days.

(21) Appl. No.: 09/739,041

(22) Filed: Dec. 18, 2000

(51) Int. Cl.[7] ..... H05B 3/00

(52) U.S. Cl. ..... 392/376; 392/426; 392/440; 392/373; 248/161

(58) Field of Search ..... 392/373, 374–376, 392/366, 422, 426–429, 440; 416/110, 247 R, 164, 100; 415/126; 248/161, 162.1, 404, 414

(56) References Cited

U.S. PATENT DOCUMENTS

| | | | | |
|---|---|---|---|---|
| 1,440,171 | * | 12/1922 | Papini | 392/440 |
| 2,618,434 | * | 11/1952 | Farnsworth | 416/100 |
| 3,051,820 | * | 8/1962 | Krichton | 392/373 |
| 3,377,465 | * | 4/1968 | Ronk | 392/373 |
| 5,720,594 | * | 2/1998 | Snow | 416/100 |
| 6,215,956 | * | 4/2001 | Lee | 392/440 |

FOREIGN PATENT DOCUMENTS

| | | | |
|---|---|---|---|
| 820732 | * | 11/1951 | (DE) . |
| 577196 | * | 1/1994 | (EP) . |
| 589098 | * | 5/1925 | (FR) . |
| 867253 | * | 5/1961 | (GB) . |

* cited by examiner

*Primary Examiner*—John A. Jeffery
(74) *Attorney, Agent, or Firm*—Ladas and Parry

(57) ABSTRACT

Disclosed herein is a radiant heater with a halogen lamp. The heater includes a base connected to a power supply cord. A power shut-off switch is mounted on the bottom of the base. A support column is mounted on the top of the base and provided with a height control button at its upper portion. A retractable rod is inserted into the support column and supported by a spring. A neck is rotatably connected to the upper end of the retractable rod. A head is fixed to the top of the neck, the head including a reversible motor. An operating rod is fixed to the upper portion of the neck at its one end and rotatably connected to the rotating shaft of the reversible motor. A support projection is mounted on the front of the head. A reflector and a reflector cover are fixed between the head and the support projection. A lamp cover is fixed to the front of the support projection for distributing far infrared rays to the reflector and preventing the eyes of a user from being dazzled. A halogen lamp is spaced inwardly somewhat apart from the lamp cover, the halogen lamp being supported by a lamp holder fixed to the support projection at its one end and radially arranged. A protective grill is clamped together with the reflector and the reflector cover by clamping means.

1 Claim, 2 Drawing Sheets

RADIANT HEATER WITH HALOGEN LAMP

BACKGROUND OF THE INVENTION

1. Field of the Invention

The present invention relates generally to a radiant heater with a halogen lamp used to increase room temperature in the winter season, and more particularly to a radiant heater in which a halogen lamp is mounted in the front of the heater, so that a large amount of heat is radiated in a short period of time, thereby being capable of maintaining an optimum room temperature.

2. Description of the Prior Art

As well known to those skilled in the art, in order to maintain a room at an optimum temperature, a variety of heating apparatus have been proposed. These heating apparatus employ liquid or gaseous fuel, and increase room temperature to an optimum value and maintain the optimum room temperature using heat emitted during the combustion of the fuel.

However, in the case of utilizing such liquid or gaseous fuel, combustion gas generated during the combustion of such fuel causes room air to be contaminated and does harm to a user. Accordingly, the user has to frequently ventilate the room by opening a window, which causes a room to be deprived of heat, thus resulting in waste of fuel.

In order to overcome the shortcoming of the conventional heating apparatus, there has been developed another type of heating apparatus with heating wires that convert electrical energy, instead of liquid or gaseous energy, to thermal energy. However, in this type of apparatus, excessive electricity consumption occurs in the heating wires, to impose a heavy economic burden on the user.

SUMMARY OF THE INVENTION

Accordingly, the present invention has been made keeping in mind the above problems occurring in the prior art, and an object of the present invention is to provide a radiant heater with a halogen lamp in which a halogen lamp, which emits a large amount of far infrared radiation while consuming a relatively small amount of electricity, thereby emitting a large amount of heat in a short period of time and therefore maintaining a room at an optimum temperature.

In order to accomplish the above object, the present invention provides a radiant heater with a halogen lamp, comprising: a base connected to a power supply cord, the base being provided with an oscillation control switch, a timer control switch and a temperature control switch; a power shut-off switch mounted on the bottom of the base, the power shut-off switch allowing electricity to be applied to the heater when the bottom of the base is in full contact with a floor; a support column stood on the top of the base and provided with a height control button at its upper portion; a retractable rod inserted into the support column and supported by a spring disposed on a spring holder; a neck rotatably connected to the upper end of the retractable rod; a head fixed to the top of the neck, the head including a reversible motor; an operating rod fixed to the upper portion of the neck at its one end and rotatably connected to the rotating shaft of the reversible motor; a support projection mounted on the front of the head; a reflector and a reflector cover fixed between the head and the support projection, the reflector and the reflector cover being spaced apart from each other; a lamp cover fixed to the front of the support projection for distributing far infrared rays to the reflector and preventing the eyes of a user from being dazzled; a halogen lamp spaced inwardly somewhat apart from the lamp cover, the halogen lamp being supported by a lamp holder fixed to the support projection at its one end and radially arranged; and a protective grill clamped together with the reflector and the reflector cover by clamping means.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
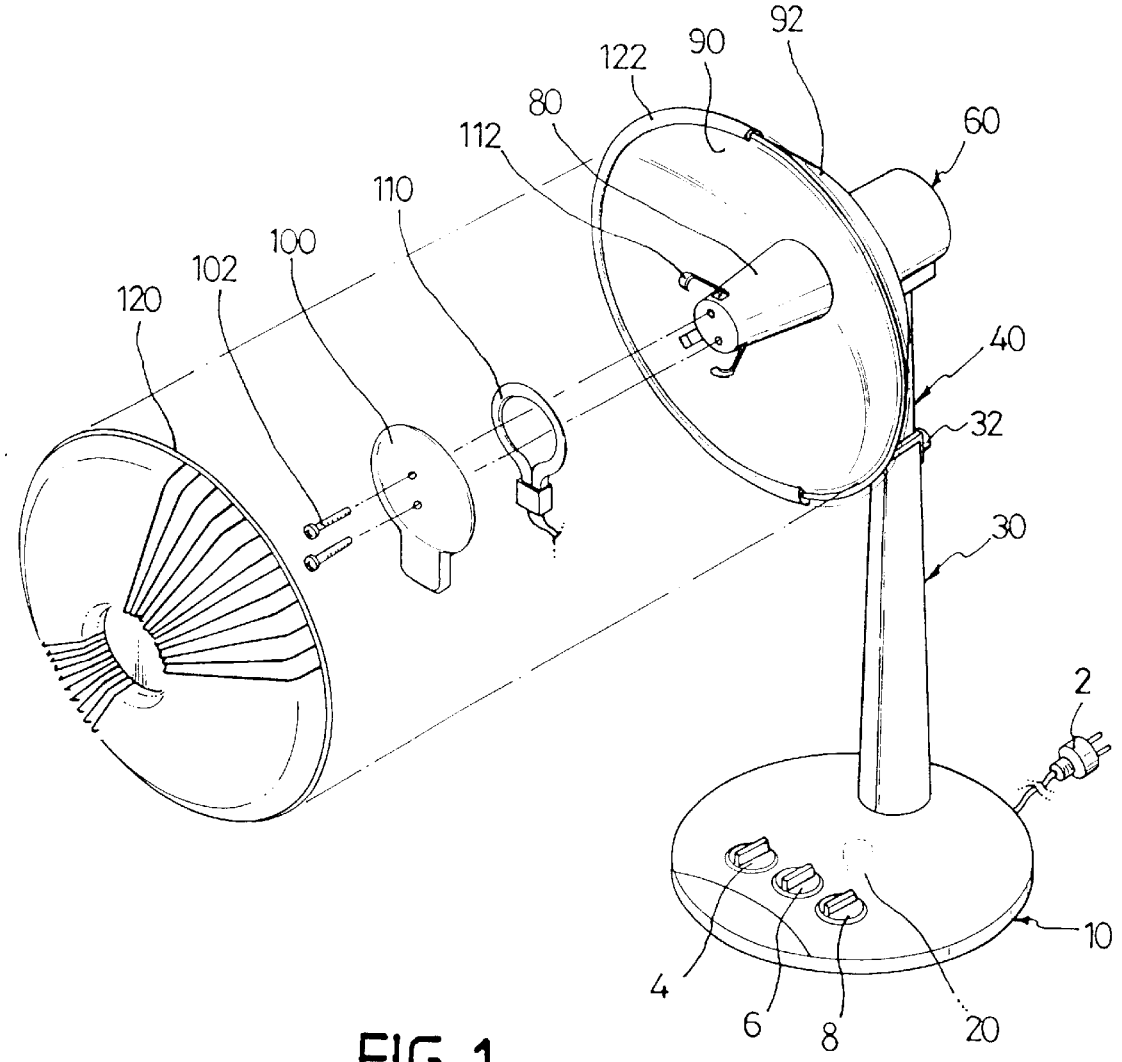
FIG. 1 is an exploded perspective view showing a radiant heater with a halogen lamp in accordance with the present invention.

Reference now should be made to the drawings, in which the same reference numerals are used throughout the different drawings to designate the same or similar components.

Figure 2:
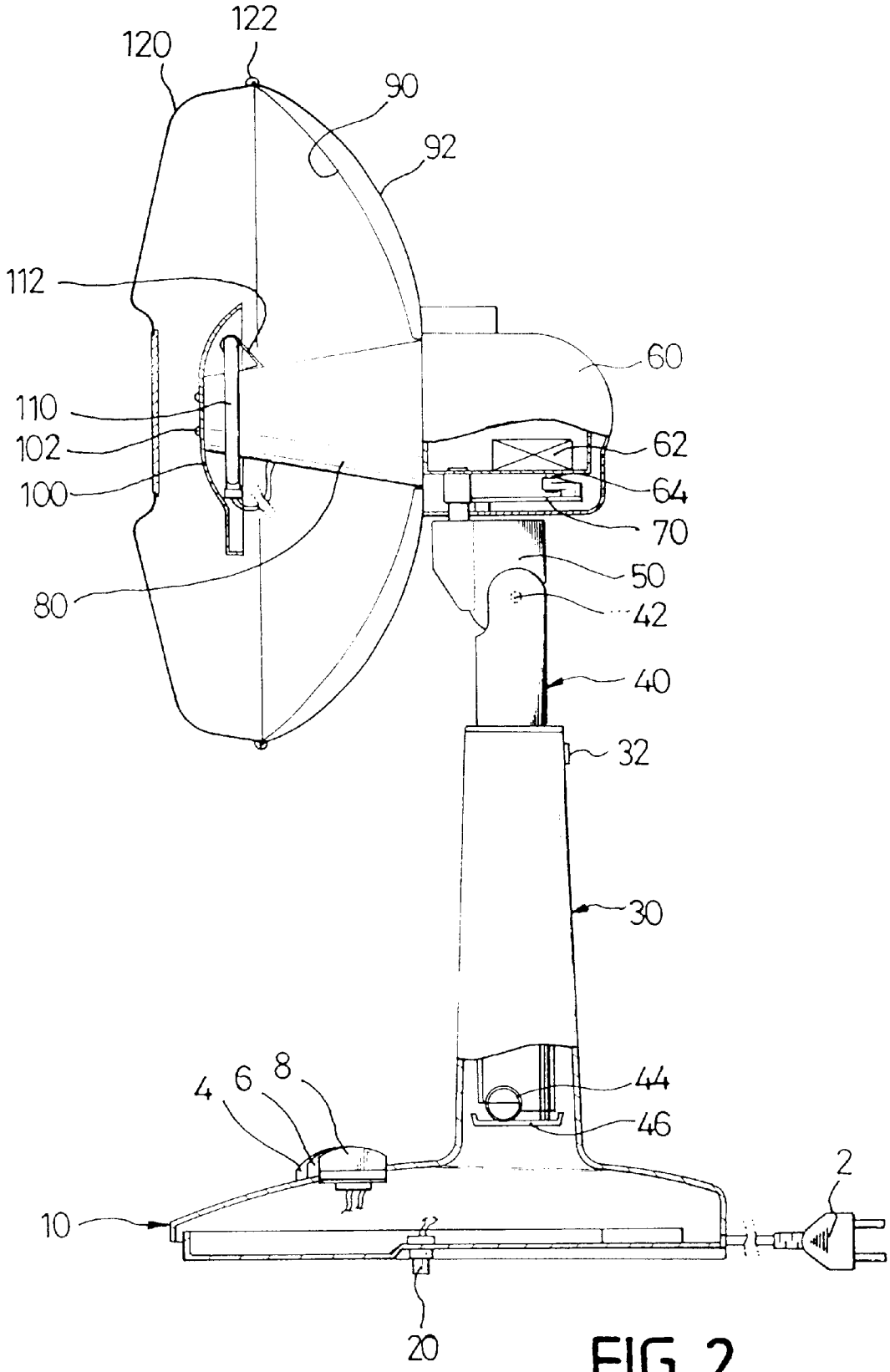
FIG. 2 is a partial cross-section showing the radiant heater with a halogen lamp in an assembled state.

As illustrated in FIGS. 1 and 2, reference numeral 10 designates a base that is used to place a radiant heater with a halogen lamp on a floor. A power supply cord 2 is connected to the rear of the base 10 to supply power to the heater.

An oscillation control knob 4, a timer control knob 6 and a temperature control knob 8 are arranged on the front upper surface of the base 10 in order. The oscillation control knob 4 serves to select between the oscillation of a parabolic reflector (will be later described) and the stoppage of the oscillation of the reflector by controlling a reversible motor (will be later described). The timer control knob 6 serves to control the period of time for which a halogen lamp (will be later described) emits far infrared rays to heat room air. The temperature control knob 8 serves to control the amount of heat generated by far infrared rays that are emitted from a halogen lamp (will be later described), using a variable resistor (not shown).

A power shut-off switch 20 is disposed on the center of the bottom of the base 10. The power shut-off switch 20 turns on electricity while the bottom of the base 10 is in full contact with a floor and accordingly the switch 20 is pushed into the base 10, and turns off electricity while the bottom of the base 10 is out of contact with the floor and accordingly the switch 20 is projected out of the base 10.

A support column 30 is stood on the top of the base 10. A height adjustment button 32 is situated on the upper portion of the support column 30.

A retractable rod 40 is inserted into the bore of the support column 30 to be extended by the operation of the height adjustment button 32. A neck 50 is hinged to the upper end of the retractable rod 40 by a hinge pin 42. A spring holder 46 is placed on the lower end of the bore of the support column 30, and a spring 44 is interposed between the lower end of the retractable rod 40 and the upper surface of the spring holder 46.

A head 60 is fixedly placed on the top of the neck 50.

The head 60 includes a reversible motor 62 in which the direction of oscillation can be reversed by means of the oscillation control knob 4.

An operating rod 70 is connected to the rotating shaft 64 of the reversible motor 62 at its one end and to the upper end of the neck 50 at its other end, thereby oscillating the head 60 to the right and left.

A support truncated-cone 80 is fixed to the front of the head 60. A parabolic reflector 90 and a reflector cover 92 are fixed between the head 60 and the support truncated-cone 80 while being somewhat spaced apart from each other to prevent heat from being transmitted from the parabolic reflector 90 to the reflector cover 92.

A lamp cover 100 is fixed to the front of the support truncated-cone 80 by means of bolts 102 to distribute far infrared rays to the reflector and prevent the eyes of a user from being dazzled. The halogen lamp 110 is placed somewhat away from the lamp cover 100 by means of a lamp holder 112. The lamp holder 112 consists of three elastic strips, the strips being secured to the support truncated-cone 80 at their one-side ends and holding the halogen lamp 110 at their other side ends.

A protective grill 120 is secured along the peripheral edges of the reflector 90 and the reflector cover 92, so as to prevent people and objects from coming into contact with the halogen lamp 100 while the radiant heater with a halogen lamp is activated by the application of electricity. A clamping rim 122 is employed to secure the protective grill 120 to the reflector 90 and the reflector cover 92.

Hereinafter, the operation of the radiant heater with a halogen lamp is described.

First of all, a user connects the power cord 2 provided on the rear of the base 10 to an external source of power. If the bottom of the base 10 is horizontally placed on a floor, electricity is not shut off by the power shut-off switch 20. Accordingly, electricity is applied to the radiant heater with a halogen lamp and the radiant heater is operated.

When the oscillation control knob 4 is manipulated to be "ON", electricity is applied to the motor 62 and the rotating shaft 64 of the motor 62 is operated. When the rotating shaft of the motor 62 is operated, the operating rod 70 connected to the side of the rotating shaft 64 of the motor 62 at its one end is operated. Since the other end of the operating rod 70 is rotatably connected to the upper portion of the neck 50, the head 60 including the motor 62 is oscillated to the right and left.

Since the stand truncated-cone 80, the parabolic reflector 90, the reflector cover 92 and the halogen lamp 110 are oscillated as the head 60 is oscillated, the far infrared rays can be radiated over a wide range.

The temperature control knob 8 transmits a signal to the halogen lamp 110 through a control unit (not shown), so that the amount of far infrared radiation is adjusted to be fit for a set temperature by increasing the amount of far infrared radiation or reducing the amount of far infrared radiation.

The height adjustment button 32 mounted on the upper portion of the support column 30 is used to adjust the position of emission of far infrared rays up and down. When a user pushes the height adjustment button 32, the retractable rod 40 inserted into the support column 30 is unlocked, moved upward by the restoring force of the spring 44 disposed under the lower end of the support column 30 and fixed at a higher proper position by the height adjustment button 32. As a result, the position of the halogen lamp 110 is moved upward and emits far infrared rays from a higher position, so that room temperature can be uniformly increased. On the other hand, when the user forcibly pushes the head 60 downward, the retracted retractable rod 40 is unlocked, moved downward and fixed at a proper lower position by the height adjustment button 32.

As described above, the present invention provides a radiant heater with a halogen lamp, which is capable of reducing electricity consumption by emitting a large amount of heat using a halogen lamp and which is capable of maintaining a room at an optimum temperature by emitting far infrared rays over a wide area.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A radiant heater with a halogen lamp, comprising:

a base connected to a power supply cord, said base being provided with an oscillation control switch, a timer control switch and a temperature control switch;

a power shut-off switch mounted on the bottom of the base, said power shut-off switch allowing electricity to be applied to the heater when the bottom of the base is in full contact with a floor;

a support column stood on the top of the base and provided with a height control button at its upper portion;

a retractable rod inserted into the support column and supported by a spring disposed on a spring holder;

a neck rotatably connected to the upper end of the retractable rod;

a head fixed to the top of the neck, said head including a reversible motor;

an operating rod fixed to the upper portion of the neck at its one end and rotatably connected to the rotating shaft of the reversible motor;

a support projection mounted on the front of the head;

a reflector and a reflector cover fixed between the head and the support projection, said reflector and said reflector cover being spaced apart from each other;

a lamp cover fixed to the front of the support projection for distributing far infrared rays to the reflector and preventing the eyes of a user from being dazzled;

a halogen lamp spaced inwardly somewhat apart from the lamp cover, said halogen lamp being supported by a lamp holder fixed to the support projection at its one end and radially arranged; and a protective grill clamped together with the reflector and the reflector cover by clamping means.

* * * * *